United States Patent [19]

Partridge et al.

[11] Patent Number: 5,019,665

[45] Date of Patent: May 28, 1991

[54] SHAPE-SELECTIVE PROCESS FOR CONCENTRATING DIAMONDOID-CONTAINING HYDROCARBON SOLVENTS

[75] Inventors: Randall D. Partridge, W. Trenton; D. Duayne Whitehurst, Titusville, both of N.J.

[73] Assignee: Mobil Oil Corp., Fairfax, Va.

[21] Appl. No.: 510,772

[22] Filed: Apr. 18, 1990

[51] Int. Cl.[5] ..... C07C 7/00

[52] U.S. Cl. ..... 585/803; 203/29

[58] Field of Search ..... 585/803; 203/29

[56] References Cited

U.S. PATENT DOCUMENTS

| | | | |
|---|---|---|---|
| Re. 28,398 | 4/1975 | Chen et al. | 208/111 |
| 3,755,138 | 8/1973 | Chen et al. | 208/33 |
| 3,956,102 | 5/1976 | Chen et al. | 208/93 |
| 4,100,056 | 7/1978 | Reynolds | 208/57 |
| 4,358,395 | 11/1982 | Haag et al. | 252/411 R |
| 4,508,836 | 4/1985 | Haag et al. | 502/53 |

OTHER PUBLICATIONS

Kirk-Othmer Encyclopedia of Chemical Technology, 3rd ed., Vol. 9, pp. 706–709, (1980).

*Primary Examiner*—Curtis R. Davis
*Assistant Examiner*—William C. Dienler
*Attorney, Agent, or Firm*—Alexander J. McKillop; Charles J. Speciale; Robert B. Furr, Jr.

[57] ABSTRACT

Diamondoid compounds are concentrated in a solvent mixture containing at least 20% by weight of normal and slightly branched $C_5$–$C_{30}$ paraffins by selectively converting the paraffins to lower boiling aliphatic hydrocarbons and separating the lower boiling aliphatics from the solvent mixture to yield a concentrated solvent mixture enriched in diamondoid compounds. Useful shape selective catalysts include zeolites having Constraint Indices from about 1 to about 12, such as ZSM-5 and MCM-22.

15 Claims, 2 Drawing Sheets

SHAPE-SELECTIVE PROCESS FOR CONCENTRATING DIAMONDOID-CONTAINING HYDROCARBON SOLVENTS

BACKGROUND OF THE INVENTION

Natural gas production may be complicated by the presence of certain heavy hydrocarbons in the subterranean formation in which the gas is found. Under conditions prevailing in the subterranean reservoirs, the heavy hydrocarbons may be partially dissolved in the compressed gas or finely divided in a liquid phase. The decrease in temperature and pressure attendant to the upward flow of gas as it is produced to the surface result in the separation of solid hydrocarbonaceous material from the gas. Such solid hydrocarbons may form in certain critical places such as on the interior wall of the production string, thus restricting or actually plugging the flow passageway.

Many hydrocarbonaceous mineral streams contain some small proportion of these diamondoid compounds. These high boiling, saturated, three-dimensional polycyclic organics are illustrated by adamantane, diamantane, triamantane and various side chain substituted homologues, particularly the methyl derivatives. Diamondoid compounds have high melting points and high vapor pressures for their molecular weights and have recently been found to cause problems during production and refining of hydrocarbonaceous minerals, particularly natural gas, by condensing out and solidifying, thereby clogging pipes and other pieces of equipment. For a survey of the chemistry of diamondoid compounds, see Fort, Jr., Raymond C., *The Chemistry of Diamond Molecules,* Marcel Dekker, 1976.

In recent times, new sources of hydrocarbon minerals have been brought into production which, for some unknown reason, have substantially larger concentrations of diamondoid compounds. Whereas in the past, the amount of diamondoid compounds has been too small to cause operational problems such as production cooler plugging, now these compounds represent both a larger problem and a larger opportunity. The presence of diamondoid compounds in natural gas has been found to cause plugging in the process equipment requiring costly maintenance downtime to remove. On the other hand, these very compounds which can deleteriously affect the profitability of natural gas production are themselves valuable products.

Various processes have been developed to prevent the formation of such precipitates or to remove them once they have formed. These include mechanical removal of the deposits and the batchwise or continuous injection of a suitable solvent. Recovery of one such class of heavy hydrocarbons, i.e. diamondoid materials, from natural gas is detailed in commonly assigned copending U.S. Patent Applicatin Ser. No. 405,119, U.S. Pat. No. 4,952,748 filed Sept. 7, 1989, which is a continuation of 358,758, filed May 26, 1989, now abandoned, as well as U.S. Patent Applications Ser. Nos. 358,759, (U.S. Pat. No. 4,952,747) 358,760, (U.S. Pat. No. 4,952,747) and 358,761, all filed May 26, 1989. The text of these U.S. Patent Applications is incorporated herein by reference.

Research efforts have more recently been focused on separating diamondoid compounds from the liquid solvent stream described, for example, in the above cited U.S. Patent Application 405,119. The diamondoid and solvent components have proven difficult to separate via conventional multistage distillation due at least in part to the overlapping boiling ranges of the preferred solvents and the commonly occurring diamondoid compounds. Further, the diamondoid compounds have been found to deposit in the overhead condenser circuit of a solvent distillation apparatus. Developing the commercial potential of these valuable components is then predicated upon the discovery of an economical method for separating diamondoids from the solvent.

In accordance with the present invention, it has surprisingly been found that solutions of diamondoid compounds in selected solvents may be concentrated by selectively converting at least a portion of the solvent to a product more readily separable from the diamondoid compounds. More specifically, it has been discovered that the normal and slightly branched paraffinic fraction of a solvent suitable for dissolving diamondoid compounds is selectively converted to lighter aliphatics under certain process conditions chosen to avoid substantial conversion of the diamondoid compounds.

SUMMARY OF THE INVENTION

The present inventive process employs a medium pore catalyst, for example, a zeolite having a Constraint Index of from about 1 to about 12, in conjunction with process conditions to favor selective catalytic cracking of the paraffinic fraction. The process conditions are preferably as severe as practical without cracking substantial portions of diamondoid compounds.

The present invention therefore includes a method for concentrating diamondoid compounds in a solvent comprising the steps of:

(a) providing a solvent mixture containing at least 50% by weight of normal or slightly branched $C_5$–$C_{30}$ paraffins having dissolved therein at least one diamondoid compound;

(b) selectively converting at least a portion of said normal or slightly branched $C_5$–$C_{30}$ paraffins to lower boiling aliphatics by contacting said solvent mixture with a shape-selective catalyst under conversion conditions selected to prevent substantial conversion of said diamondoid compound;

(c) separating said lower boiling aliphatics from said solvent mixture to yield a concentrated solvent mixture enriched in said diamondoid compound.

DETAILED DESCRIPTION

Solvent Feedstocks

Figure 1:
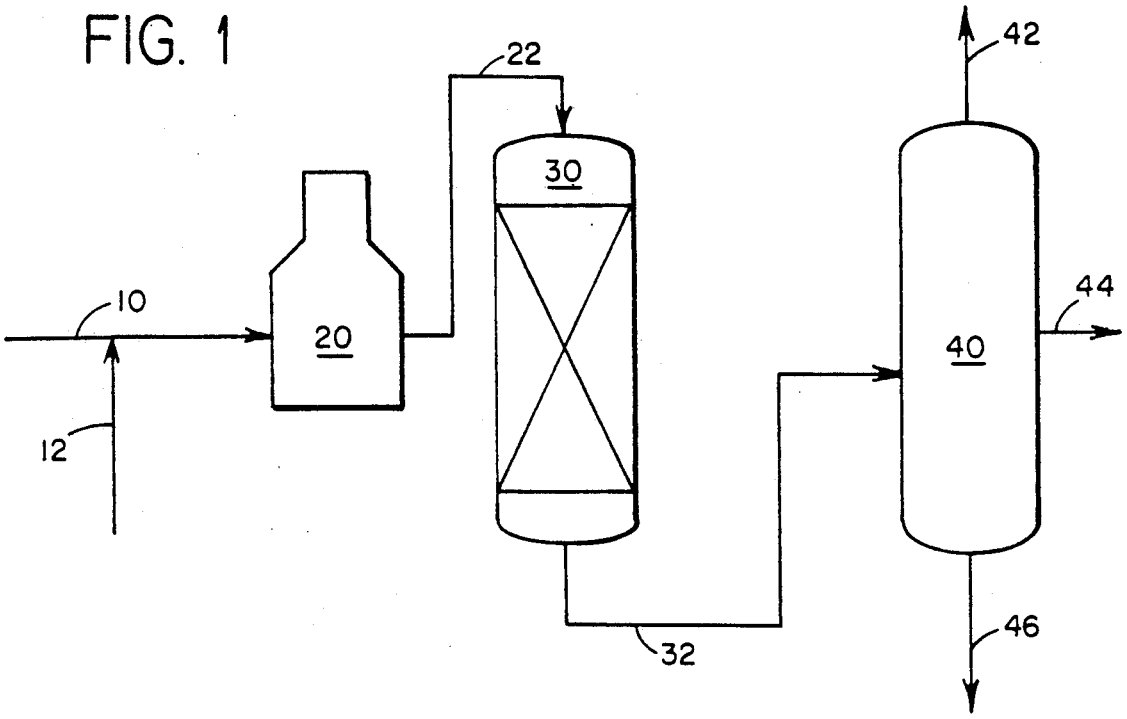
FIG. 1 is simplified schematic diagram showing the major processing steps of the present invention

Hydrocarbon feedstocks which can be selectively converted according to the present process include various refinery streams including naphtha distillate cuts from a crude oil fractionation tower, and distillate boiling range streams from which aromatics have been extracted. Examples of such solvent extraction treatments are raffinates from a hydrocarbon mixture which has had aromatics removed by a solvent extraction treatment. Examples of such solvent extraction treatments are described on pages 706–709 of the *Kirk-Othmer Encyclopedia of Chemical Technology,* Third Edition, Vol. 9 (1980). A particularly preferred feedstream derived from such a solvent extraction treatment is a Udex raffinate. The paraffinic hydrocarbon feedstock suitable for use in the present process may comprise at least 75 percent by weight, e.g. at least 85 percent by weight, of paraffins having from 5 to 30 carbon atoms, preferably from 10 to 20 carbon atoms.

Solvents highly enriched in a single $C_{10}$–$C_{20}$ normal or slightly branched paraffin species may also be used.

The solvent feedstocks differ from those preferred for conventional hydrodewaxing processes in that excessive paraffinicity is an undesirable trait for conventional hydrodewaxing process feedstocks but is a preferred characteristic for solvent feeds in the present process. Excessive paraffinicity exacts an unacceptable yield loss in conventional catalytic hydrodewaxing processes by converting normally liquid paraffins to light $C_4$ aliphatics. Thus, in conventional catalytic dewaxing, the extent of liquid loss is inversely related to product yield. The process objective of conventional catalytic dewaxing is to produce a liquid product and therefore, paraffinicity is undesirable. But in the process of the present invention, the object is to concentrate and isolate diamondoid compounds and cracking the normal and slightly branched paraffins is in fact highly desirable. Moreover, it is preferable to control process conditions to maximize the extent of paraffin cracking while avoiding reacting the diamondoid compounds.

Paraffin Conversion Catalysts

Catalysts useful in conjunction with the present invention include zeolites and other crystalline materials which selectively convert normal and slightly branched paraffins to lighter aliphatics while leaving bulkier molecules essentially unreacted under the selected conversion conditions.

The members of the class of zeolites useful herein have an effective pore size of generally from about 5 to about 8 Angstroms, such as to freely sorb normal hexane. In addition, the structure must provide constrained access to larger molecules. It is sometimes possible to judge from a known crystal structure whether such constrained access exists. For example, if the only pore windows in a crystal are formed by 8-membered rings of silicon and aluminum atoms, then access by molecules of larger cross-section than normal hexane is excluded and the zeolite is not of the desired type. Windows of 10-membered rings are preferred, although, in some instances, excessive puckering of the rings or pore blockage may render these zeolites ineffective.

Although 12-membered rings in theory would not offer sufficient constraint to produce advantageous conversions, it is noted that the puckered 12-ring structure of TMA offretite does show some constrained access. Other 12-ring structures may exist which may be operative for other reasons, and therefore, it is not the present intention to entirely judge the usefulness of the particular zeolite solely from theoretical structural considerations.

A convenient measure of the extent to which a zeolite provides control to molecules of varying sizes to its internal structure is the Constraint Index of the zeolite. The method by which the Constraint Index is determined is described in U.S. Pat. No. 4,016,218, incorporated herein by reference for details of the method. U.S. Pat. No. 4,696,732 discloses Constraint Index values for typical zeolite materials and is incorporated by reference as if set forth at length herein.

In one embodiment, the catalyst may comprise a zeolite described on pages 706-709 of the Kirk-Othmer Encyclopedia of having a Constraint Index of from about 1 to about 12. Examples of such zeolite catalysts include ZSM-5, ZSM-11, ZSM-12, ZSM-22, ZSM-23, ZSM-35 and ZSM-48.

Zeolite ZSM-5 and the conventional preparation thereof are described in U.S. Pat. No. 3,702,886, the disclosure of which is incorporated herein by reference. Other preparations for ZSM-5 are described in U.S. Pat. Nos. Re. 29,948 (highly siliceous ZSM-5); 4,100,262 and 4,139,600, the disclosure of these is incorporated herein by reference. Zeolite ZSM-11 and the conventional preparation thereof are described in U.S. Pat. No. 3,709,979, the disclosure of which is incorporated herein by reference. Zeolite ZSM-12 and the conventional preparation thereof are described in U.S. Pat. No. 3,832,449, the disclosure of which is incorporated herein by reference. Zeolite ZSM-23 and the conventional preparation thereof are described in U.S. Pat. No. 4,076,842, the disclosure of which is incorporated herein by reference. Zeolite ZSM-35 and the conventional preparation thereof are described in U.S. Pat. No. 4,016,245, the disclosure of which is incorporated herein by reference. Another preparation of ZSM-35 is described in U.S. Pat. No. 4,107,195, the disclosure of which is incorporated herein by reference. ZSM-48 and the conventional preparation thereof is taught by U.S. Pat. No. 4,375,573, the disclosure of which is incorporated herein by reference. Mordenite, which is also useful to catalyze the present process, is described in U.S. Pat. No. 4,100,056, the disclosure of which is incorporated herein by reference.

In another embodiment, the catalyst comprises a synthetic porous crystalline material characterized by an X-ray diffraction pattern including interplanar d-spacings at 12.36 ±0.4, 11.03 ±0.2, 8.83 ±0.14, 6.18 ±0.12, 6.00 ±0.10, 4.06 ±0.07, 3.91 ±0.07 and 3.42 ±0.06 Angstroms.

In its calcined form, the synthetic porous crystalline material component of the catalyst composition identified above by its interplanar d-spacings is further characterized by an X-ray diffraction pattern including the following lines:

TABLE A

| Interplanar d-Spacing (A) | Relative Intensity, $I/I_o \times 100$ |
|---|---|
| 12.36 ± 0.4 | M-VS |
| 11.03 ± 0.2 | M-S |
| 8.83 ± 0.14 | M-VS |
| 6.18 ± 0.12 | M-VS |
| 6.00 ± 0.10 | W-M |
| 4.06 ± 0.07 | W-S |
| 3.91 ± 0.07 | M-VS |
| 3.42 ± 0.06 | VS |

Alternatively, this synthetic porous crystalline material component may be characterized by an X-ray diffraction pattern in its calcined form including the following lines:

TABLE B

| Interplanar d-Spacing (A) | Relative Intensity, $I/I_o \times 100$ |
|---|---|
| 30.0 ± 2.2 | W-M |
| 22.1 ± 1.3 | W |
| 12.36 ± 0.4 | M-VS |
| 11.03 ± 0.2 | M-S |
| 8.83 ± 0.14 | M-VS |

TABLE B-continued

| Interplanar d-Spacing (A) | Relative Intensity, $I/I_o \times 100$ |
|---|---|
| 6.18 ± 0.12 | M-VS |
| 6.00 ± 0.10 | W-M |
| 4.06 ± 0.07 | W-S |
| 3.91 ± 0.07 | M-VS |
| 3.42 ± 0.06 | VS |

More specifically, the calcined form of this synthetic porous crystalline material component may be characterized by an X-ray diffraction pattern including the following lines:

TABLE C

| Interplanar d-Spacing (A) | Relative Intensity, $I/I_o \times 100$ |
|---|---|
| 12.36 ± 0.4 | M-VS |
| 11.03 ± 0.2 | M-S |
| 8.83 ± 0.14 | M-VS |
| 6.86 ± 0.14 | W-M |
| 6.18 ± 0.12 | M-VS |
| 6.00 ± 0.10 | W-M |
| 5.54 ± 0.10 | W-M |
| 4.92 ± 0.09 | W |
| 4.64 ± 0.08 | W |
| 4.41 ± 0.08 | W-M |
| 4.25 ± 0.08 | W |
| 4.10 ± 0.07 | W-S |
| 4.06 ± 0.07 | W-S |
| 3.91 ± 0.07 | M-VS |
| 3.75 ± 0.06 | W-M |
| 3.56 ± 0.06 | W-M |
| 3.42 ± 0.06 | VS |
| 3.30 ± 0.05 | W-M |
| 3.20 ± 0.05 | W-M |
| 3.14 ± 0.05 | W-M |
| 3.07 ± 0.05 | W |
| 2.99 ± 0.05 | W |
| 2.82 ± 0.05 | W |
| 2.78 ± 0.05 | W |
| 2.68 ± 0.05 | W |
| 2.59 ± 0.05 | W |

Most specifically, the calcined form of this synthetic porous crystalline material component may be characterized by an X-ray diffraction pattern including the following lines:

TABLE D

| Interplanar d-Spacing (A) | Relative Intensity, $I/I_o \times 100$ |
|---|---|
| 30.0 ± 2.2 | W-M |
| 22.1 ± 1.3 | W |
| 12.36 ± 0.4 | M-VS |
| 11.03 ± 0.2 | M-S |
| 8.83 ± 0.14 | M-VS |
| 6.86 ± 0.14 | W-M |
| 6.18 ± 0.12 | M-VS |
| 6.00 ± 0.10 | W-M |
| 5.54 ± 0.10 | W-M |
| 4.92 ± 0.09 | W |
| 4.64 ± 0.08 | W |
| 4.41 ± 0.08 | W-M |
| 4.25 ± 0.08 | W |
| 4.10 ± 0.07 | W-S |
| 4.06 ± 0.07 | W-S |
| 3.91 ± 0.07 | M-VS |
| 3.75 ± 0.06 | W-M |
| 3.56 ± 0.06 | W-M |
| 3.42 ± 0.06 | VS |
| 3.30 ± 0.05 | W-M |
| 3.20 ± 0.05 | W-M |
| 3.14 ± 0.05 | W-M |
| 3.07 ± 0.05 | W |
| 2.99 ± 0.05 | W |
| 2.82 ± 0.05 | W |
| 2.78 ± 0.05 | W |

TABLE D-continued

| Interplanar d-Spacing (A) | Relative Intensity, $I/I_o \times 100$ |
|---|---|
| 2.68 ± 0.05 | W |
| 2.59 ± 0.05 | W |

These values were determined by standard techniques. The radiation was the K-alpha doublet of copper and a diffractometer equipped with a scintillation counter and an associated computer was used. The peak heights, I, and the positions as a function of 2 theta, where theta is the Bragg angle, were determined using algorithms on the computer associated with the diffractometer. From these, the relative intensities, 100 $I/I_o$, where $I_o$ is the intensity of the strongest line or peak and d (obs.) the interplanar spacing in Angstrom Units (A), corresponding to the recording lines, were determined. In Tables A-D, the relative intensities are given in terms of the symbols W=weak, M=medium, S=strong, VS= very strong. In terms of intensities, these may be generally designated as follows:

W=0–20
M=20–40
S=40–60
VS=60–100

It should be understood that these X-ray diffraction patterns are characteristic of all species of the zeolite. The sodium form as well as other cationic forms reveal substantially the same pattern with some minor shifts in interplanar spacing and variation in relative intensity. Other minor variations can occur depending on the ratio of structural components, e.g. silicon to aluminum mole ratio of the particular sample, as well as its degree of thermal treatment.

Examples of such porous crystalline materials include the PSH-3 composition of U.S. Pat. No. 4,439,409, incorporated herein by reference, and MCM-22.

Zeolite MCM-22 has a composition involving the molar relationship:

$$X_2O_3\,(n)\,YO_2,$$

wherein X is a trivalent element, such as aluminum, boron, iron and/or gallium, preferably aluminum, Y is a tetravalent element such as silicon and/or germanium, preferably silicon, and n is at least about 10, usually from about 10 to about 150, more usually from about 10 to about 60, and even more usually from about 20 to about 40. In the as-synthesized form, zeolite MCM-22 has a formula, on an anhydrous basis and in terms of moles of oxides per n moles of $YO_2$, as follows:

$$(0.005\text{–}0.1)Na_2O{:}(1\text{–}4)R{:}X_2O_3\,{:}nYO_2$$

wherein R is an organic component. The Na and R components are associated with the zeolite as a result of their presence during crystallization, and are easily removed by post-crystallization methods hereinafter more particularly described.

Zeolite MCM-22 is thermally stable and exhibits a high greater than about 400 $m^2/gm$ as measured by the BET (Bruenauer, Emmet and Teller) test and unusually large sorption capacity when compared to previously described crystal structures having similar X-ray diffraction patterns. As is evident from the above formula, MCM-22 is synthesized nearly free of Na cations and thus possesses acid catalysis activity as synthesized. It can, therefore, be used as a component of the catalyst composition herein without having to first undergo an exchange step. To the extent desired, however, the original sodium cations of the as-synthesized material can be replaced in accordance with techniques well known in the art, at least in part, by ion exchange with other cations. Preferred replacement cations include metal ions, hydrogen ions, hydrogen precursor, e.g. ammonium, ions and mixtures thereof.

In its calcined form, zeolite MCM-22 appears to be made up of a single crystal phase with little or no detectable impurity crystal phases and has an X-ray diffraction pattern including the lines listed in above Tables A–D.

Naturally occurring clays which can be composited with the zeolite crystals include the montmorillonite and kaolin family, which families include the subbentonites, and the kaolins commonly known as Dixie, McNamee, Georgia and Florida clays or others in which the main mineral constituent is halloysite, kaolinite, dickite, nacrite, or anauxite. Such clays can be used in the raw state as originally mined or initially subjected to calcination, acid treatment or chemical modification. Binders useful for compositing with the zeolite also include inorganic oxides, notably alumina.

Apart from or in addition to the foregoing binder materials, the zeolite crystals can be composited with an inorganic oxide matrix such as silica-alumina, silica-magnesia, silica-zirconia, silica-thoria, silica-beryllia, silica-titania, as well as ternary compositions such as silica-alumina-thoria, silica-alumina-zirconia, silica-alumina-magnesia, silica-magnesia-zirconia, etc. It may be advantageous to provide at least a part of the foregoing matrix materials in colloidal form so as to facilitate extrusion of the bound catalyst component(s).

The relative proportions of finely divided crystalline material and inorganic oxide matrix can vary widely with the zeolite content ranging from about 1 to about 95 weight percent by weight and more usually, particularly when the composite is prepared in the form of beads, in the range of about 2 to about 80 weight percent of the composite.

Paraffin Conversion Process

The selective catalytic conversion of normal and slightly branched paraffinic hydrocarbons proceeds under relatively mild conditions. The selective catalytic dewaxing of lubricant and distillate feedstocks operates by selectively cracking the waxy (paraffinic) components of the feed. This results in a yield loss because the paraffinic components which are in the desired boiling range undergo a bulk conversion to lower boiling fractions which, although they may be useful in other products, must be removed from the lube stock. Thus consideration of a dewaxing process for lubricant or distillate upgrading must be predicated upon the certain knowledge that the relative concentration of normal and branched paraffins in the feed is sufficiently small that the loss of these liquid components via cracking to lighter aliphatics will not exact a yield loss large enough to render the process uneconomical.

The process of the present invention, on the other hand, seeks to maximize selective cracking of normal and slightly branced paraffins to the extent possible while avoiding conversion of the diamondoid component dissolved in the solvent feedstock. The primary object of this selective paraffin conversion is to decrease the boiling range of the solvent components so that a fraction concentrated in diamondoid compounds may be more easily isolated by fractionation. A secondary object of this selective paraffin conversion is to produce a light olefin stream for upgrading in other refinery or petrochemical plant processes. In contrast to previous dewaxing processes in which the most preferred feedstreams contained only moderate levels of waxy paraffins, paraffin-rich feedstocks are most preferred for use in the present invention. Liquid losses which would render conventional dewaxing processes uneconomical are expected and indeed preferred in the present process, not only to facilitate concentration of diamondoids in the unconverted solvent, but also to produce light olefinic by-products which are valuable petrochemical feedstocks.

Catalytic dewaxing of hydrocarbon oils to reduce the temperature at which precipitation of waxy hydrocarbons occurs is described, for example, in the *Oil and Gas Journal*, Jan. 6, 1975, pages 69–73. A number of patents have also described catalytic dewaxing processes. For example, U.S. Pat. No. RE. 28,398 describes a process for catalytic dewaxing with a catalyst comprising a medium-pore zeolite and a hydrogenation/dehydrogenation component. U.S. Pat. No. 3,956,102 describes a process for hydrodewaxing a gas oil with a medium-pore zeolite catalyst. U.S. Pat. No. 4,100,056 describes a Mordenite catalyst containing a Group VI or a Group VIII metal which may be used to dewax a distillate derived from a waxy crude. U.S. Pat. No. 3,755,138 describes a process for mild solvent dewaxing to remove high quality wax from a lube stock, which is then catalytically dewaxed to specification pour point.

Operating conditions for the catalytic conversion process of the present invention include elevated temperature usually ranging from about 400° to about 800° F. (205° to 425° C.), but more typically range from about 500° to 700° F. (260° to 370° C.), depending on the severity required to selectively crack paraffins without converting the diamondoid fraction. The catalyst is progressively deactivated as coke (a mixture of hydrogen deficient hydrocarbons) is deposited on the catalyst particles, blocking access to the pores and thus to the bulk of the catalytically active sites. Increasing the conversion temperature offsets the loss in catalyst activity and may be continued until the conditions become reach the point of converting diamondoids. Diamondoid compounds typically show excellent thermal stability and would likely remain essentially unreacted up to about 800° F. (427° C.) in the presence of the catalysts described above. When the catalyst activity has diminished to the point at which the temperature required for paraffin cracking causes substantial quantities, e.g., about 10% by weight, of diamondiods in the solvent feedstream to convert to lighter hydrocarbons, feed to the catalytic reaction zone is discontinued and the catalyst is regenerated by conventional means. Examples of conventional regeneration techniques include flowing a gas contained a controlled concentration of hydrogen or oxygen at elevated temperature through the catalyst bed.

Referring now to the Figure, the diamondoid-containing solvent feedstream, optionally mixed with added hydrogen, flows through line 10 to process furnace 20 where the feedstream is heated to conversion temperature. Hydrogen is not required stoichiometrically but promotes extended catalyst life by reductive coke removal. The process is therefore carried out in the presence of hydrogen, typically at 400–800 psig (2860 to 562 kPa, abs.) although pressures outside this range can be effectively employed. If light olefins are the desired by-products, lower hydrogen pressures are used and the frequency of catalyst regeneration is increased accordingly. The hydrogen addition rate is typically 1000 to 4000 SCF/bbl, usually 2000 to 3000 SCF/bbl of liquid feed (about 180 to 710, usually 355 to 535 n.1.1.$^{-1}$). Space velocity will vary according to the chargestock and the severity needed to convert the paraffins while leaving the diamondoid materials essentially unreacted and is typically in the range of 0.25 to 5 LHSV (hr$^{-1}$), usually 0.5 to 2 LHSV.

The heated feedstream continues through line 22 to reactor 30 which contains a solid catalyst, preferably a medium-pore zeolite catalyst as described above. The reactor is schematically shown as a downflow fixed bed reactor. However, other reactor configurations may be effectively employed such as radial flow fixed bed, moving bed and fluid bed.

During the cycle, the temperature of the catalyst is progressively raised to compensate for decreasing catalyst activity. Eventually, however, the temperature reaches a maximum end-of-cycle temperature, at which reactivation or regeneration of the dewaxing catalyst becomes necessary because excessively high temperatures increase the extent of non-selective catalytic and thermal cracking. Specifically, the end-of-cycle temperature is defined by the extent of diamondoid cracking, and is preferably the highest temperature at which no more than 10% by weight of the diamondoids in the feedstream are cracked to lighter materials at given conditions of weight hourly space velocity and hydrogen pressure. Reactivation may be carried out using hydrogen at elevated temperatures as described, for instance, in U.S. Pat. Nos. 4,358,395 and 4,508,836, to which reference is made for details of such processes. Regeneration may be carried out oxidatively after several hydrogen reactivations to remove hard coke deposits.

Reactivation is typically carried out at temperatures of 600° −1000° F. (about 315° −540° C.) using at least 97 percent pure hydrogen at 200–600 psig (about 1480–4240 kPa abs) or higher, with a low water concentration in order to avoid hydrothermal deactivation of the zeolite component in the dewaxing catalyst. The reactivation typically takes 2–4 days.

Process conditions are selected within the stated ranges to maximize cracking of normal and slightly branched paraffins without substantial conversion of diamondoid compounds. The reactor effluent is then charged to fractionator tower 40 through line 32.

The configuration of fractionator tower to is not critical to the present invention, except to the extent that bottom stream 46 be enriched in diamondoid compounds and that overhead stream 42 and side draw 44 contain a mixture of unreacted solvent and lighter aliphatic reaction products, with overhead stream 42 being enriched in the lighter aliphatic reaction products.

Side draw stream 44 may be recycled to gas/liquid contacting means (not shown) to dissolve additional diamondoid compounds for recovery. Overhead stream 44 contains a mixture of light aliphatics which may be suitable for further upgrading.

EXAMPLE

Diamondoids were concentrated in a paraffinic distillate raffinate by contacting a solution of diamondoids in the paraffinic distillate raffinate with a composite catalyst containing about 65% of Ni-ZSM-5 composited in an inert binder. The nickel content of the ZSM-5 component was about 1% by weight. Process conditions were controlled at 400 psig, 1.0 hr$^{-1}$ liquid hourly space velocity, and hydrogen dosage of about 2500 SCF/BBL of fresh feed. Reaction temperature was varied within the range of about 650° F. to about 750° F. Table E shows representative data from these runs.

TABLE E

| | Feed-stock | Product Stream | |
|---|---|---|---|
| Reaction Temp., °F. | — | 656° F. | 701° F. |
| Conversion: | | | |
| $C_1$–$C_4$, wt. % | — | 10.3 | 20.6 |
| $C_5$–330° F. Naphtha, wt. % | 1.0 | 16.3 | 18.4 |
| 330° F. + distillate, wt. % | 99.0 | 73.5 | 61.0 |
| Diamondoid Content in 330° F. + distillate, wt. % | Base | Base × 1.2 | Base × 1.5 |

Figure 2A:
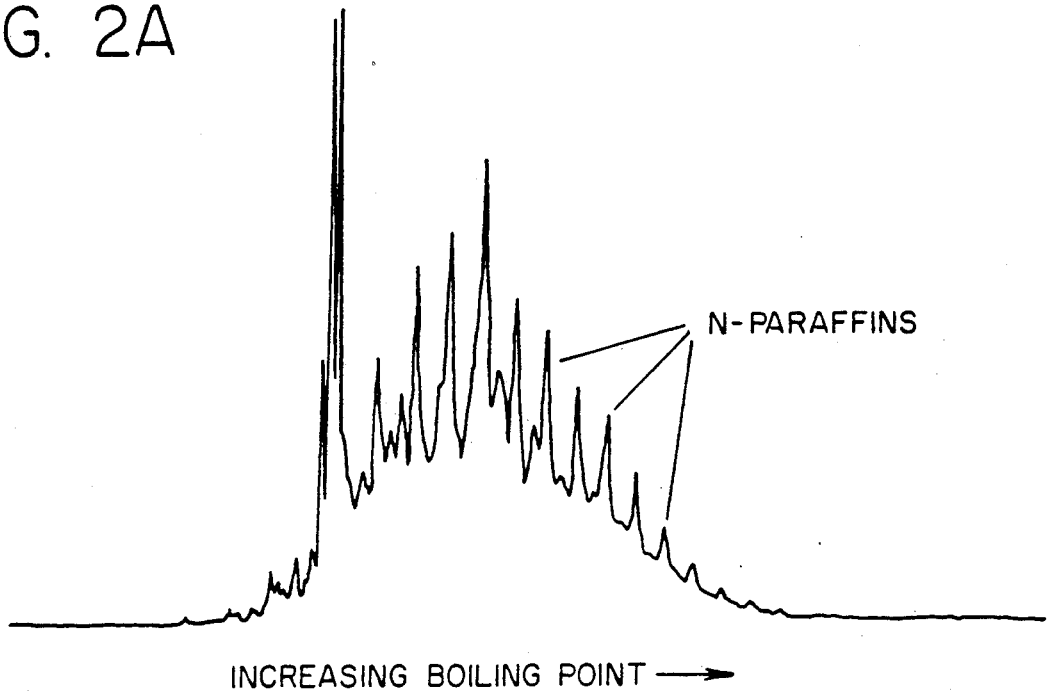
FIG. 2 shows two chromatograms which compare the 330° F.+distillate feedstock and product of the Example.
Figure 2B:
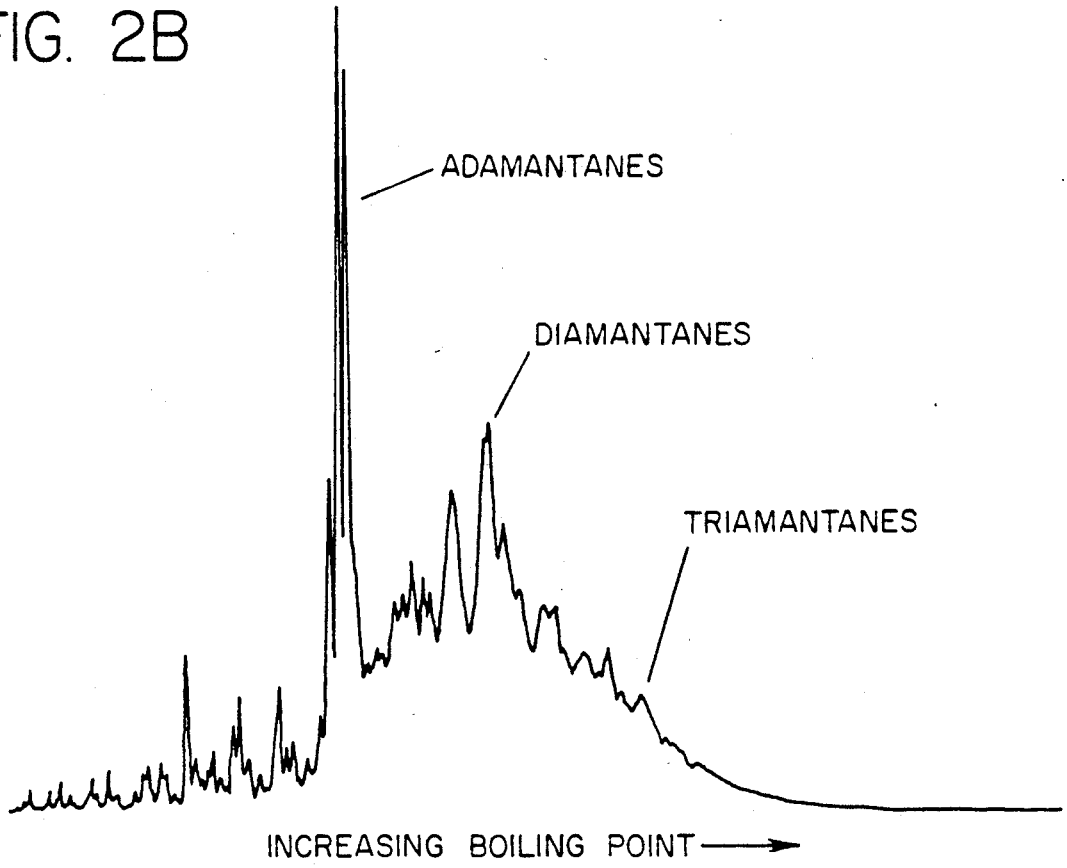

FIG. 2 shows chromatograms of the diamondoid-containing distillate feedstock and product, showing that the diamondoid materials were effectively concentrated in the product distillate by shape selective removal of n-paraffins from the distillate.

Changes and modifications in the specifically described embodiments can be carried out without departing from the scope of the invention which is intended to be limited only by the scope of the appended claims.

We claim:

1. A method for concentrating diamondoid compounds in a solvent comprising the steps of:

(a) providing a solvent mixture containing at least 20% by weight of normal or slightly branched paraffins having from 5 to 30 carbon atoms with at least one diamondoid compound dissolved therein;

(b) contacting said solvent mixture of step (a) with a shape-selective catalyst under conversion conditions to convert at least a portion of said normal or slightly branched paraffins to lower boiling aliphatics and to prevent conversion of more than about 10% by weight of said diamondoid compounds; and (c) separating said lower boiling aliphatics from said solvent mixture to yield a concentrated solvent mixture enriched in said diamondoid compound.

2. The method of claim 1 wherein said solvent contains at least 10% by weight of normal paraffins having from 10 to 20 carbon atoms.

3. The method of claim 1 wherein said solvent comprises a mineral-oil derived distillate boiling range stock.

4. The method of claim 1 wherein said solvent comprises a paraffinic raffinate from a solvent extraction process.

5. The method of claim 4 wherein said paraffinic raffinate comprises a Udex raffinate.

6. The method of claim 1 wherein said catalyst has the structure of at least one selected from the group consisting of ZSM-5, ZSM-11, ZSM-12, ZSM-22, ZSM-23, ZSM-35 and ZSM-48.

7. A method for concentrating diamondoid compounds in a solvent comprising the steps of:

(a) providing a solvent mixture containing at least 20% by weight of normal or slightly branched paraffins having from 5 to 30 carbon atoms with at least one diamondoid compound dissolved therein;

(b) contacting said solvent mixture of step (a) with a shape-selective catalyst characterized by an X-ray diffraction pattern as shown in Table A of the specification under conversion conditions to convert at least a portion of said normal or slightly branched paraffins to lower boiling aliphatics and to prevent conversion of more than about 10% by weight of said diamondoid compounds; and (c) separating said lower boiling aliphatics from said solvent mixture to yield a concentrated solvent mixture enriched in said diamondoid compound.

8. The method of claim 7 wherein said shape selective catalyst is further characterized by an X-ray pattern having interplanar d-spacings as shown in Table B of the specification.

9. The method of claim 8 wherein said shape selective catalyst is further characterized by an X-ray pattern having interplanar d-spacings as shown in Table C of the specification.

10. The method of claim 9 wherein said shape selective catalyst is further characterized by an X-ray pattern having interplanar d-spacings as shown in Table D of the specification.

11. The method of claim 7 wherein said solvent comprises a mineral-oil derived distillate boiling rang stock.

12. The method of claim 7 wherein said solvent comprises a paraffinic raffinate from a solvent extraction process.

13. The method of claim 12 wherein said paraffinic raffinate comprises a Udex raffinate.

14. A method for concentrating diamondoid compounds in a solvent comprising the steps of:

(a) providing a solvent mixture containing at least 20% by weight of normal or slightly branched paraffins having from 5 to 30 carbon atoms with at least one diamondoid compound dissolved therein;

(b) contacting said solvent mixture of step (a) with a shape-selective catalyst under conversion conditions selected to maximize conversion of non-diamondoid constituents in said solvent mixture to $C_4$-light aliphatics while converting less than about 10% by weight of said diamondoid compound; and (c) separating said lower boiling aliphatics from said solvent mixture to yield a concentrated solvent mixture enriched in said diamondoid compound.

15. The method of claim 14 further comprising controlling said conversion conditions to minimize liquid yield.

* * * * *